US006192726B1

(12) United States Patent
Castricum

(10) Patent No.: US 6,192,726 B1
(45) Date of Patent: Feb. 27, 2001

(54) SYSTEM AND METHOD FOR CORRUGATING SPIRAL FORMED PIPE

(75) Inventor: Wilhelmus P. H. Castricum, Ormond Beach, FL (US)

(73) Assignee: Lindab AB, Bastad (SE)

( * ) Notice: Subject to any disclaimer, the term of this patent is extended or adjusted under 35 U.S.C. 154(b) by 0 days.

(21) Appl. No.: 09/434,899

(22) Filed: Nov. 5, 1999

(51) Int. Cl.[7] ..... B21C 37/12
(52) U.S. Cl. ..... 72/49
(58) Field of Search ..... 72/49, 50, 367.1, 72/368

(56) References Cited

U.S. PATENT DOCUMENTS

| | | | |
|---|---|---|---|
| 549,707 | 11/1895 | Denney . | |
| 684,539 | 10/1901 | Cartwright . | |
| 694,524 | 3/1902 | Boyd . | |
| 957,966 | 5/1910 | Jenkins . | |
| 1,345,458 | 7/1920 | Pierce . | |
| 1,372,040 | 3/1921 | Rendano . | |
| 1,478,692 | 12/1923 | Baranoff . | |
| 1,635,807 | 7/1927 | Amberg . | |
| 1,740,430 | 12/1929 | Mudd . | |
| 2,516,817 | 7/1950 | Wernli . | |
| 2,595,747 | 5/1952 | Andersen . | |
| 2,734,472 | 2/1956 | Bornand . | |
| 2,749,983 | 6/1956 | Rogers . | |
| 3,029,674 | 4/1962 | Southwell et al. . | |
| 3,122,115 | 2/1964 | Siegwart . | |
| 3,268,137 | 8/1966 | Martin . | |
| 3,472,131 | 10/1969 | Perusse et al. . | |
| 3,472,132 | 10/1969 | Perusse et al. . | |
| 3,515,038 | 6/1970 | Perusse et al. . | |
| 3,540,333 | 11/1970 | Johnson . | |
| 3,564,888 | 2/1971 | Miller . | |
| 3,606,783 * | 9/1971 | Lewis | 72/49 |
| 3,621,884 * | 11/1971 | Trihey | 72/49 |
| 3,753,363 | 8/1973 | Trihey . | |
| 3,831,470 | 8/1974 | Maroschak . | |
| 3,839,931 | 10/1974 | Herpich . | |
| 3,839,933 | 10/1974 | Paramonoff . | |
| 3,863,480 * | 2/1975 | Meserole | 72/50 |

(List continued on next page.)

FOREIGN PATENT DOCUMENTS

| | | |
|---|---|---|
| 27 24 859 A1 | 12/1978 | (DE) . |
| 0 353 622 A1 | 2/1990 | (EP) . |
| 0 384 625 A1 | 8/1990 | (EP) . |
| 0 499 915 A1 | 8/1992 | (EP) . |
| 0 583 461 | 2/1994 | (EP) . |
| 0 714 713 A1 | 6/1996 | (EP) . |
| 0 749 787 A1 | 12/1996 | (EP) . |
| 2 218 963 | 9/1974 | (FR) . |

(List continued on next page.)

OTHER PUBLICATIONS

Excerpt from Grainger Catalog: Electric Shears p. 1481, believed to be published prior to Dec. 5, 1997.
International search report for PCT/SE 98/00690 mailed Jul. 9, 1998.
International search report for EP 95 30 8157 completed Mar. 5, 1996.

*Primary Examiner*—Rodney A. Butler
(74) *Attorney, Agent, or Firm*—Brinks Hofer Gilson & Lione

(57) ABSTRACT

A method and apparatus for forming corrugated pipe is disclosed. The pipe forming apparatus includes a selectively operable corrugation module having an inner corrugation roller movably mounted relative to an outer corrugation roller via a cylinder assembly. The method includes forming a length of spiral pipe without corrugations, engaging a corrugation module to introduce a desired length of corrugated pipe, and retracting the corrugation unit to allow a second length of uncorrugated pipe to form. The uncorrugated portion of the pipe is then severed cleanly using overlapping inner and outer cutting knives.

18 Claims, 6 Drawing Sheets

U.S. PATENT DOCUMENTS

| | | | | |
|---|---|---|---|---|
| 3,866,501 | | 2/1975 | Glendenning et al. . | |
| 3,913,430 | | 10/1975 | van Dijk . | |
| 3,940,962 | | 3/1976 | Davis . | |
| 4,711,110 | | 12/1987 | Castricum . | |
| 4,058,997 | | 11/1977 | Siegwart . | |
| 4,126,064 | | 11/1978 | Tarrant | 82/92 |
| 4,292,867 | | 10/1981 | Stoffels et al. | 82/98 |
| 4,353,232 | | 10/1982 | Viesturs et al. . | |
| 4,583,389 | | 4/1986 | Thomas . | |
| 4,612,789 | | 9/1986 | Andriessen | 72/71 |
| 4,622,838 | | 11/1986 | Schafer . | |
| 4,706,481 | | 11/1987 | Castricum . | |
| 4,751,839 | | 6/1988 | Thomas . | |
| 4,823,579 | | 4/1989 | Castricum . | |
| 4,924,684 | | 5/1990 | Castricum . | |
| 4,934,225 | | 6/1990 | Languillat et al. . | |
| 4,987,808 | | 1/1991 | Sicka et al. . | |
| 5,020,351 | * | 6/1991 | Castricum | 72/49 |
| 5,063,798 | | 11/1991 | Kitaoka et al. . | |
| 5,074,018 | | 12/1991 | Binggeli et al. . | |
| 5,086,677 | | 2/1992 | Languillat . | |
| 5,105,639 | | 4/1992 | Castricum . | |
| 5,105,700 | | 4/1992 | Kusakabe . | |
| 5,193,374 | | 3/1993 | Castricum . | |
| 5,243,889 | | 9/1993 | Wallis . | |
| 5,257,521 | | 11/1993 | Castricum . | |
| 5,335,570 | | 8/1994 | Ro . | |
| 5,421,185 | | 6/1995 | Castricum . | |
| 5,477,717 | | 12/1995 | Skrebergene et al. . | |
| 5,592,741 | | 1/1997 | Vassar | 93/178 |
| 5,609,055 | | 3/1997 | Castricum . | |
| 5,636,541 | | 6/1997 | Castricum . | |
| 5,860,305 | | 1/1999 | Castricum . | |
| 5,992,275 | | 11/1999 | Castricum . | |

FOREIGN PATENT DOCUMENTS

| | | |
|---|---|---|
| 718424 | 11/1954 | (GB) . |
| 749389 | 5/1956 | (GB) . |
| 784289 | 10/1957 | (GB) . |
| 53-80881 | 7/1978 | (JP) . |
| 8-300216 | 11/1996 | (JP) . |
| WO 98/17412 | 4/1998 | (WO) . |

* cited by examiner

SYSTEM AND METHOD FOR CORRUGATING SPIRAL FORMED PIPE

FIELD OF THE INVENTION

The present invention relates to pipe formers for forming spirally formed pipes. More particularly, the present invention relates to a pipe former having the ability to add corrugations while spirally forming a pipe.

BACKGROUND

Spirally formed pipe is typically formed from a single strip of metal. As a pipe is formed, the strip of metal is coiled and adjacent edges of the strips are folded and pressed together to form a lockseam. When the spirally formed pipe reaches a desired length, a pipe cutting device severs the pipe. Spiral pipe has applications in many areas, including vehicle oil filters, culvert pipe and HVAC (heating, ventilation and air-conditioning).

In applications such as culvert pipe fabrication, it is advantageous to create corrugations in the pipe to increase the strength of the pipe. Some pipe formers accomplish this by corrugating the metal strip before it is fed into the pipeformer. A disadvantage to existing corrugated pipe formers is that they produce pipe having continuous corrugations from end to end of a pipe segment. This type of pipe is very difficult to cut with a pipe cutting knife or knives. Typically, a saw blade is used to cut corrugated pipe. Saw blades may present safety issues as well as problems with forming clean cuts on the pipe. Another drawback with pipe formers that form continuous corrugated spiral pipe is that the pipe former is limited to only forming corrugated pipe and requires changing portions of the hardware in order to also produce smooth spirally formed pipe.

DETAILED DESCRIPTION OF PRESENTLY PREFERRED EMBODIMENTS

Figure 1:
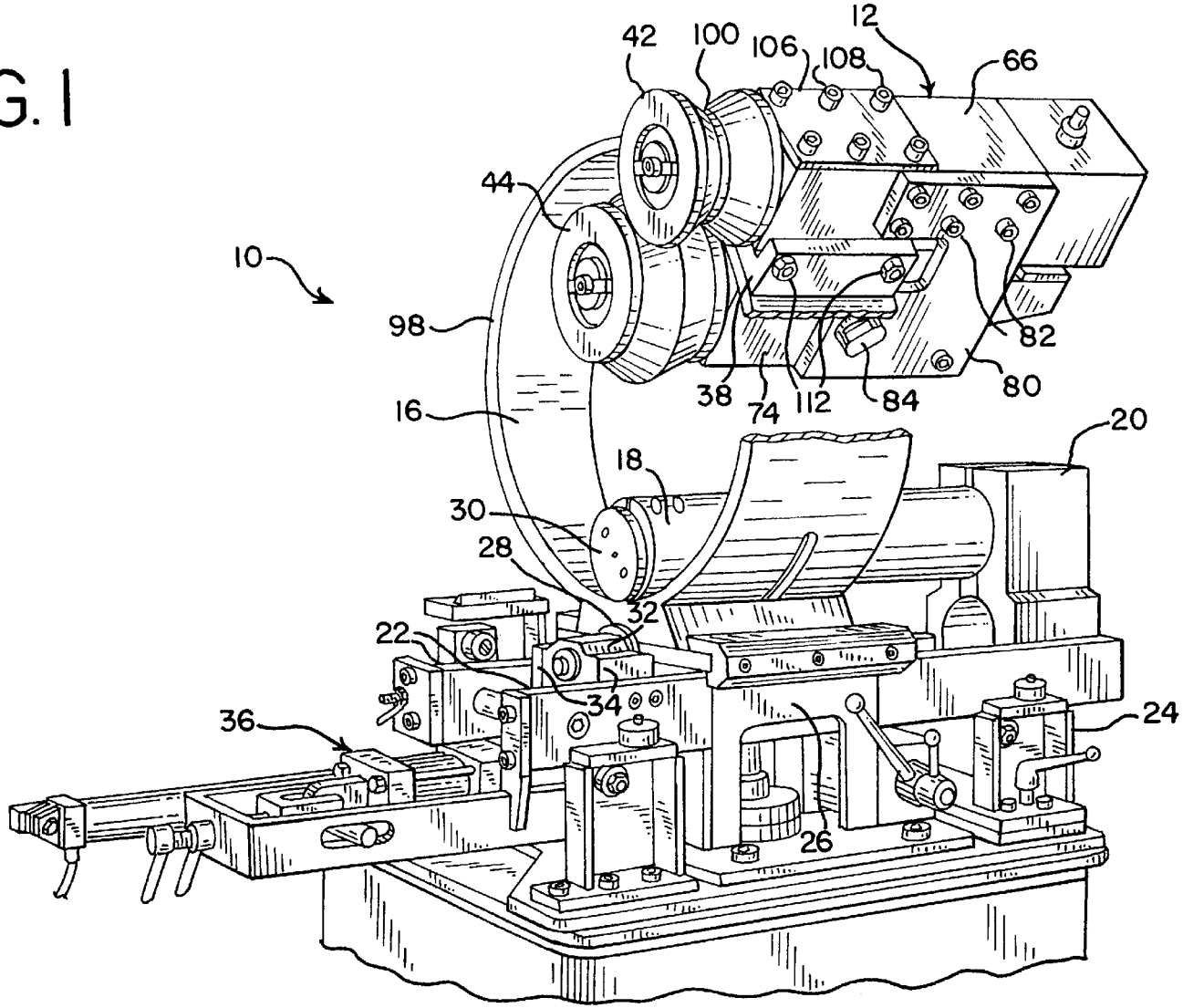
FIG. 1 is a perspective sectional view of a pipe forming and cutting apparatus according to a presently preferred embodiment.

In order to address the need for a pipe former capable of producing smooth or corrugated spiral pipe and capable of cleanly cutting sections of corrugated spiral pipe, an apparatus 10 for forming and cutting spiral corrugated pipe is described below. As shown in FIG. 1, the apparatus 10 may be constructed using an existing spiral pipe former and cutter, such as those available from Spiral-Helix, Inc. of Buffalo Grove, Ill., modified to a include a corrugation module 12. For a more detailed discussion of suitable pipe formers and cutters, reference is made to U.S. Pat. Nos. 4,706,481 and 5,636,541, the entire disclosures of which are incorporated herein by reference.

The apparatus 10 includes a fixed forming head 16 that receives a thin strip of material, preferably sheet metal, and curls the strip of material around the interior of the forming head 16. A cylindrical mandrel 18 is held by a mandrel holder 20 connected to one end of the mandrel 18. The mandrel holder 20 and attached mandrel 18 connect to a pair of runners 22 between a pair of mounting legs 24 having rollers guiding each of the runners 22. The mandrel holder 20 is rigidly attached to, and moves with, the runners. The runners are slidably mounted in the rollers on each of the legs 24. The runners pass underneath the forming head 16 and through the forming head table 26.

As shown in FIG. 1, the pipe cutting section of the apparatus 10 includes an outer knife 28 generally positioned outside the pipe (not shown). The outer knife 28 is positioned outside the pipe such that radial movement of the outer knife 28 towards the inner knife 30 will cause the knives to overlap and puncture the pipe during a cutting operation. The outer knife 28 is held in a knife holder 32 by a lock washer and lock nut connected to a shaft extending through the knife. The shaft is preferably mounted in a bearing assembly that permits passive rotation of the outer knife. Contact of the outer knife with the rotating pipe rotationally drives the outer knife 28. In an alternative embodiment, the outer knife may be actively rotated by any of a number of commonly available motors.

The knife holder 32 is movably mounted in a knife slide block 34 by a slide bearing assembly (not shown). The slide bearing assembly provides for low friction movement of the knife holder in a radial direction of the pipe. A suitable slide bearing assembly may be constructed using THK Needle Strips No. FF2025CW. The slide bearing assembly attaches to the central portion of a knife slide block 34 that is connected to the runners 24. Thus, the knife holder 32 may move in a radial direction relative to the pipe, and the knife holder and bearing assembly may move axially with respect to the pipe on the runners 24.

Figure 2:
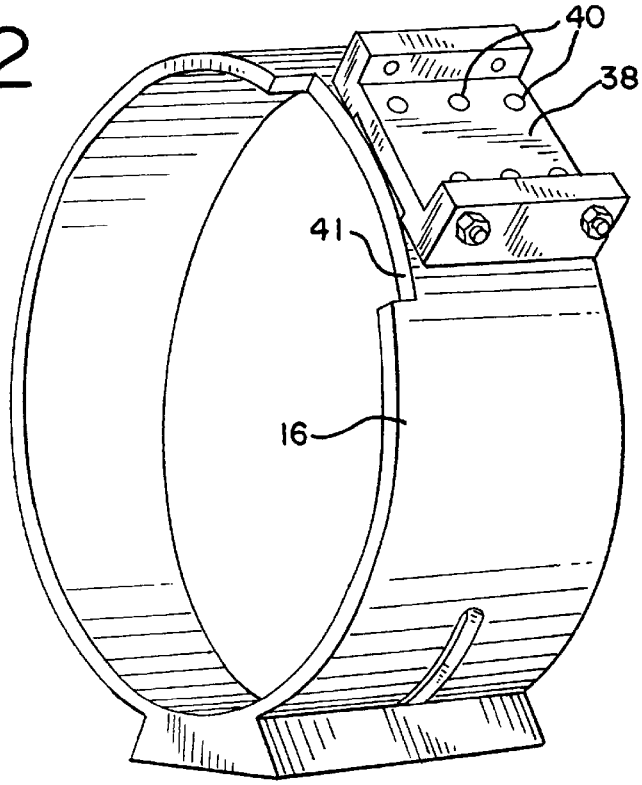
FIG. 2 illustrates a forming head for use in the apparatus of FIG. 1.

A cylinder assembly 36, which may be hydraulic or pneumatic, preferably moves the outer knife into and away from the pipe. The cylinder assembly 36 includes a cylinder that controls a piston. When the piston is fully extended, the knife holder 32 is raised into a cutting position where the inner and outer knives 30, 28 overlap and puncture the pipe. The other side of the cylinder assembly 36 also connects to the knife slide block 34 so that the entire assembly can move axially with the runners. As shown in FIG. 2, The forming head 16 includes a mounting pad 38 preferably fixedly attached to the outer circumference of the forming head and sized to receive the corrugation module 12. The mounting pad 38 includes threaded receiving holes 40 for releasably fastening the corrugation module to the forming with bolts. A recessed region 41 in the forming head permits clearance for the corrugation rollers described below.

Figure 3:
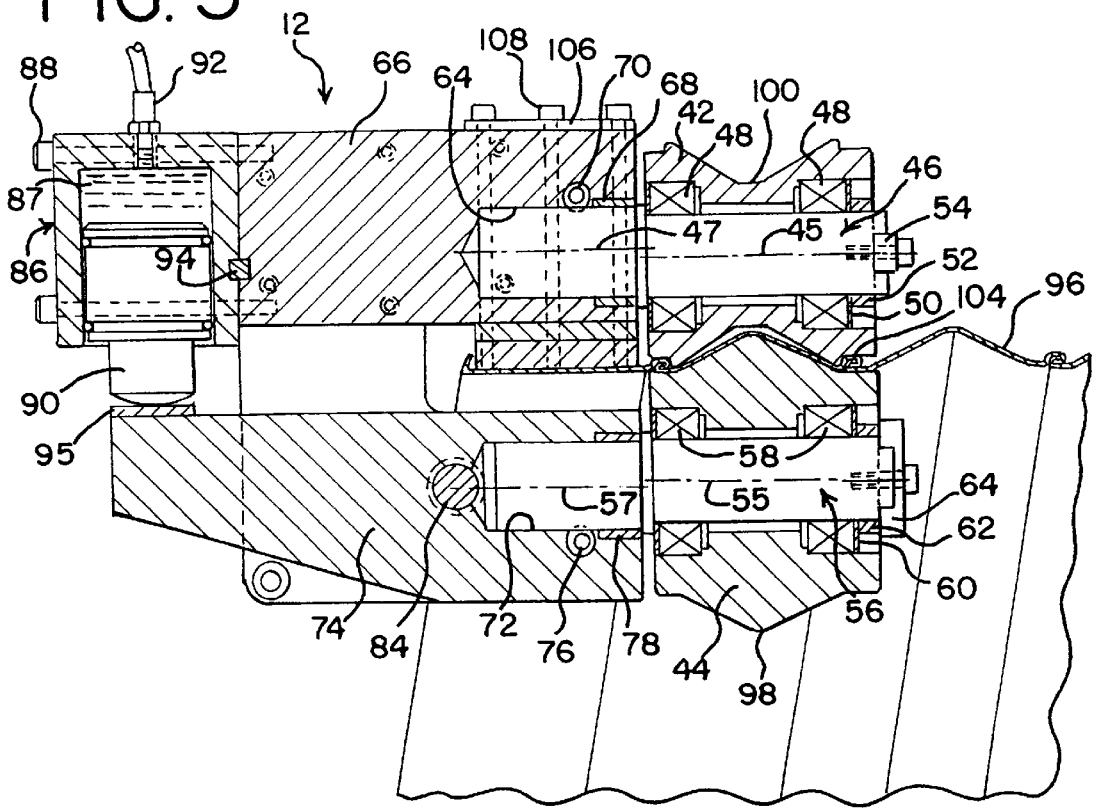
FIG. 3 is a cross-sectional side view of the corrugation module of FIG. 1 in a corrugating position.
Figure 4:
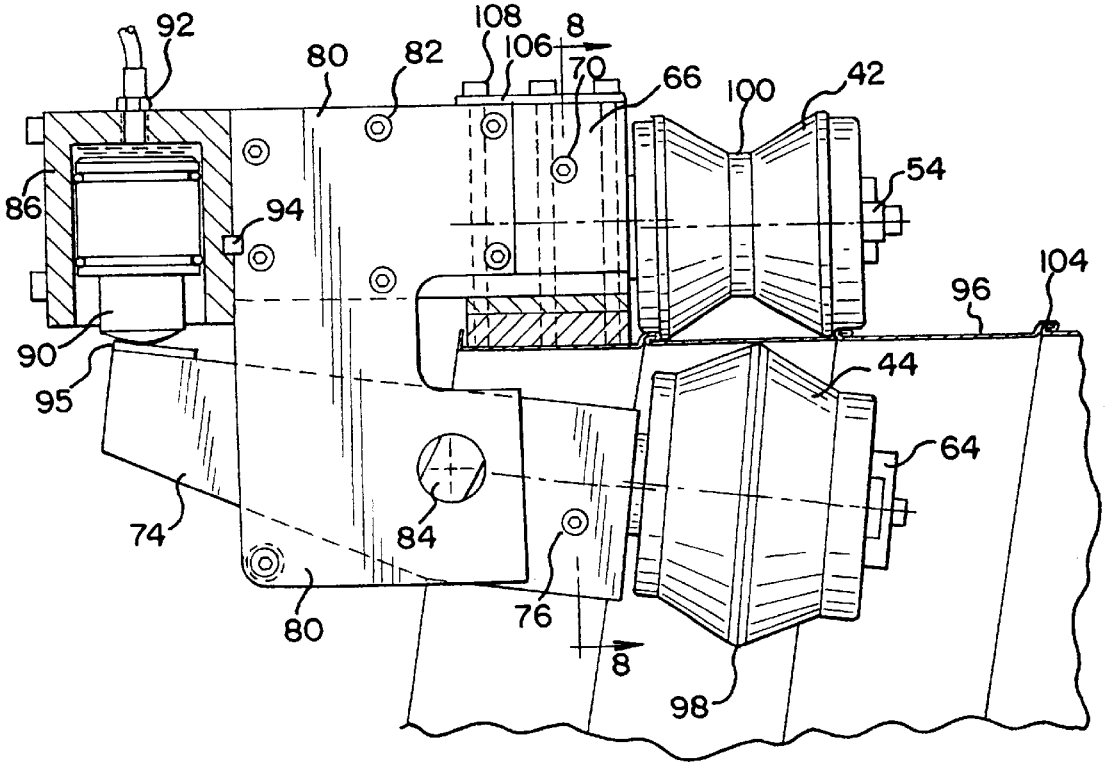
FIG. 4 is a cross-sectional side view of the corrugation module of FIG. 3 in a non-corrugating position.

Referring now to FIGS. 3 and 4, a preferred embodiment of the corrugation unit 12 is shown. The corrugation module 12 includes an outside corrugation roller 42 and an inside corrugation roller 44. The outside and inside corrugation rollers 42, 44 are preferably positioned at the exit end of the forming head where formed spiral pipe emerges prior to reaching the cutting knives. The outside corrugation roller 42 is rotatably mounted on an eccentric shaft 46 by taper bearings 48, such as part no. 33208 taper bearings available from FAG of Danbury, Conn. The bearings 48 and outside corrugation roller 42 are kept in place on the outer end of the shaft 46 by a cover plate 50, distance ring 52 and a retaining key 54 that slidably fits into a slot in the end of the shaft 46. Similarly, the inside corrugation roller is also mounted on an eccentric shaft 56 by taper bearings 58. The taper bearings 58 and inside corrugation roller 44 are held in place on the shaft 56 by a cover plate 60, distance ring 62 and retaining key 64 that slidably fits into a slot in the end of the shaft 56. In a preferred embodiment, each eccentric shaft 46, 56 has a first cylindrical portion 45, 55 on which a corrugation roller 42, 44 is coaxially mounted, and a second cylindrical portion 47, 57 that is offset from the axis of the first portion as shown in FIG. 3.

The eccentric shaft 46 of the outer corrugation roller 42 is sized to removably fit in a receiving hole 64 in the outside shaft holder 66. A heat treated sleeve 68 surrounds the eccentric shaft 46 at the opening of the receiving hole 64 and a shaft locking pin 70 keeps the shaft 46 in place. Analogous to the eccentric shaft of the outer corrugation roller, the eccentric shaft 56 of the inner corrugation roller 44 is removably held in a receiving hole 72 in the inside shaft holder 74 by a shaft locking pin 76. Also, a heat treated sleeve 78 surrounds the eccentric shaft 56 at the opening of the receiving hole 72 in the inside shaft holder 74. The heat treated sleeves 68, 78 are preferably press fit steel rings. Also, the shaft holders 66, 74 are preferably constructed of aluminum to reduce weight. Each eccentric shaft 46, 56 and each roller 42, 44 is preferably constructed of steel such as heat-treated A2 tool steel. The eccentric shafts 46, 56 are rotatably adjustable in the shaft holders to permit radial adjustment of the rollers with respect to the pipe so that the outer corrugation roller 42 may be adjusted to overlap with the inner corrugation roller and provide the proper corrugation depth. As shown in FIGS. 1 and 3–6, a pair of frame plates 80 attach to opposite sides of the outside shaft holder 66 with bolts 82. The frame plates extend down from the outside shaft holder 66 and support the inside shaft holder 74, via a pivot pin 84, at a position inside the forming head.

The outer shaft holder, preferably removably rigidly attached to the outside of the forming head, is attached to a force producing mechanism, such as a hydraulic cylinder assembly 86, via fasteners such as bolts 88. The cylinder assembly is configured to move the rollers 42, 44 between a non-corrugating position and a corrugating position. Preferably, the cylinder assembly is selected to produce enough force to bend the pipe wall with the rollers to form corrugation grooves and to maintain the rollers in an overlapping position while pipe rotates and moves longitudinally through the forming head. The cylinder may be any cylinder sized to fit on the end of the outer shaft and provide sufficient force at the rollers. In the preferred embodiment, the cylinder has a 3.5 inch bore formed in a square block of aluminum and capable of producing 24,000 pounds of force at the rollers. The cylinder assembly 86 includes a piston 90 and a hydraulic fitting and hose 92 for supplying the necessary hydraulic fluid. A key 94 is positioned between the cylinder assembly 86 and the outside shaft holder 66 and positioned to absorb the force applied by the cylinder assembly on the connection between the outer shaft holder and the cylinder assembly. The key 94 may be a square piece of steel sized to fit in a keyway formed in both the end of the shaft holder 66 and the side of the cylinder assembly 86. The end of the piston 90 is positioned to contact a wear plate 95, preferably made of steel, on the end of the inside shaft holder 74. The cylinder assembly 86 preferably pivotally moves the inside corrugation roller 44 toward or away from the outside corrugation roller 42 by controlling the cantilever motion of the inside shaft holder 74 about the pivot pin 84.

FIGS. 3 and 4 illustrate the corrugation unit 12 in a corrugating position (FIG. 3) and a non-corrugating position (FIG. 4). In the corrugating position, the piston 90 is extended out from the cylinder 87. The cantilever motion of the inner shaft holder 74 about the pivot pin 84, brought about by pressure from the piston against the wear plate, moves the inner and outer corrugation rollers together against opposite sides of a wall of the pipe 96. The circumferential protrusion 98 on the inner corrugation roller cooperates with the recessed circumferential area 100 on the outer corrugation roller to form a groove in the pipe 96 as it emerges from the forming head 16 and moves between the rollers. In one embodiment, the outer roller includes circumferential recesses 102 on its leading and trailing ends. The circumferential recesses 102 are preferably designed to receive the lockseam 104 of the pipe 96.

Figure 5:
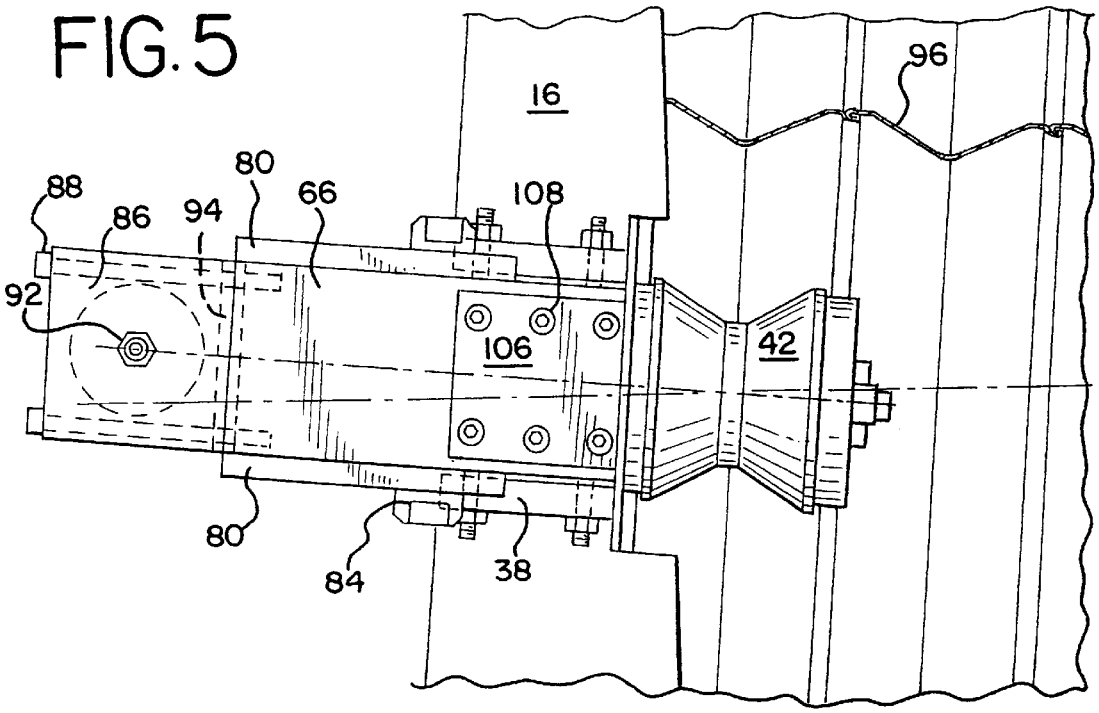
FIG. 5 is a top plan view of the corrugation module of FIGS. 3–4.
Figure 7:
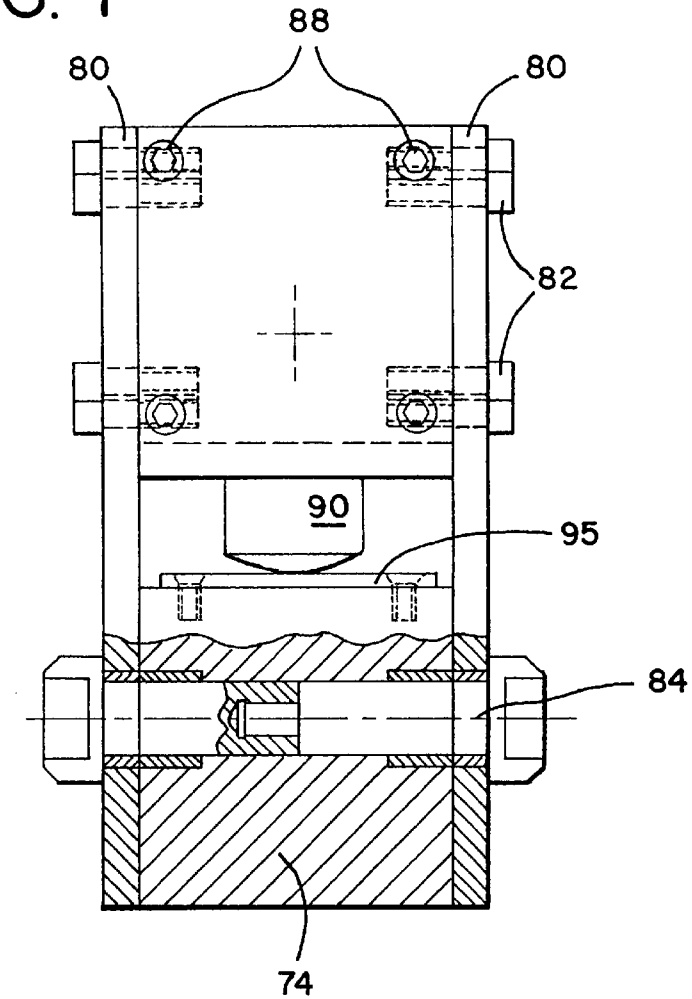
FIG. 7 is a rear sectional view of the corrugation module of FIG. 1.
Figure 6:
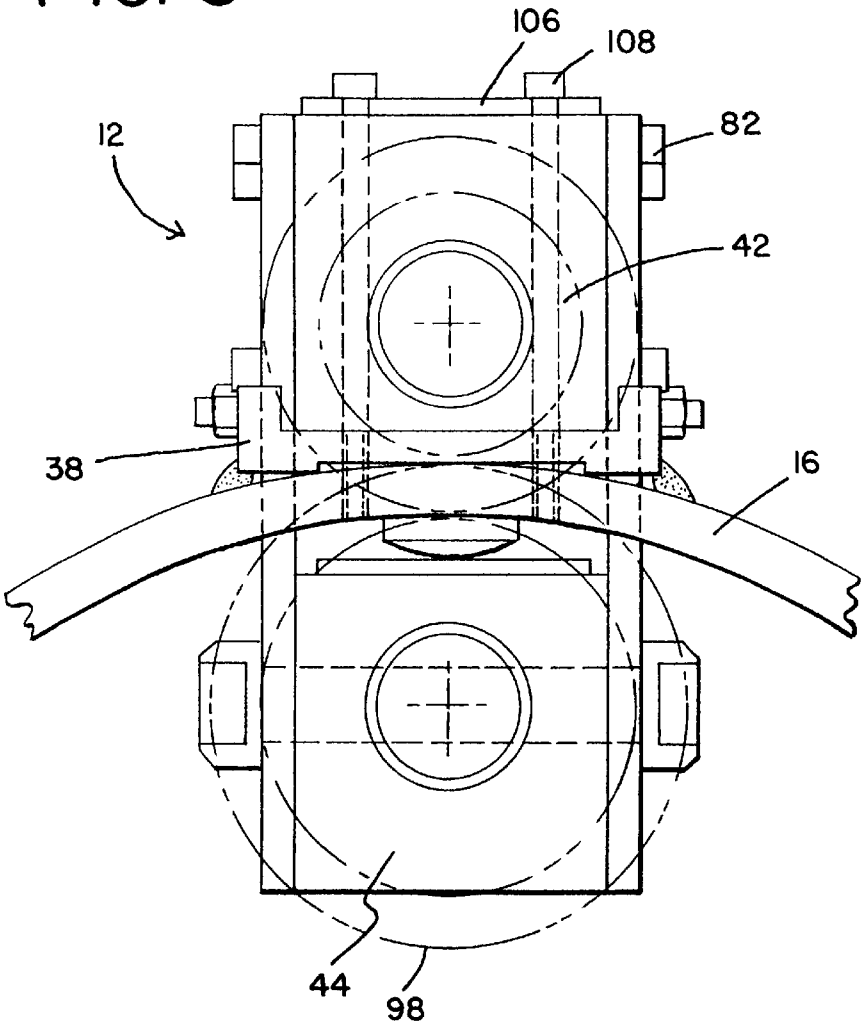
FIG. 6 is a front elevational view of the corrugation module of FIGS. 3–5 in a corrugating position.
Figure 9:
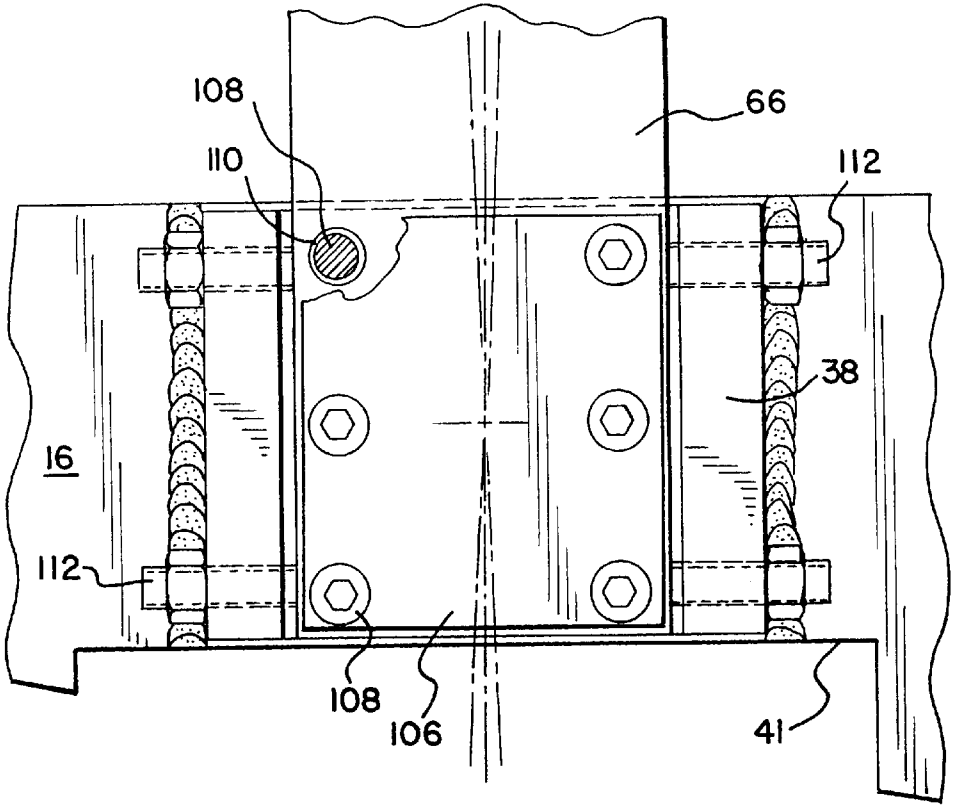
FIG. 9 is a partial top view of the corrugation module of FIG. 3.
Figure 8:
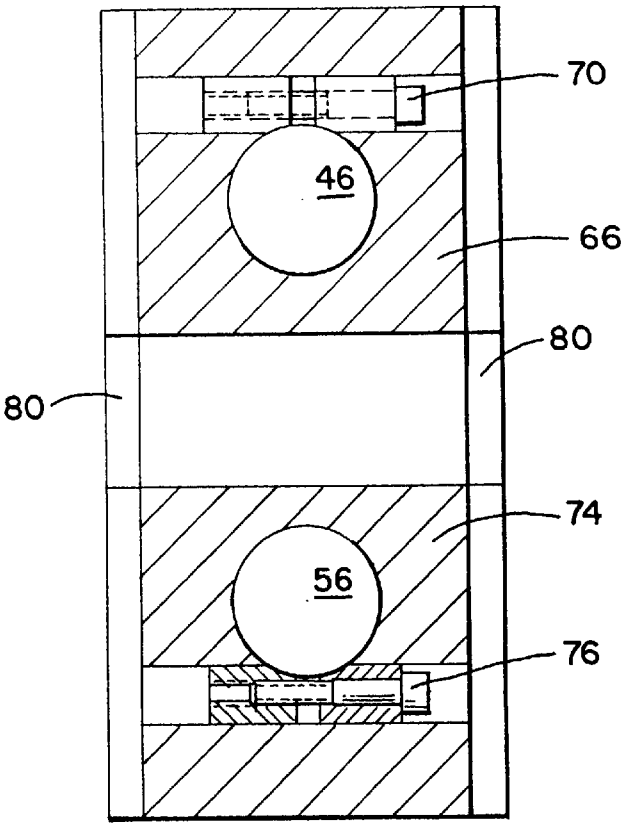
FIG. 8 is a cross-sectional view taken along line 8—8 of FIG. 4.
Figure 10:
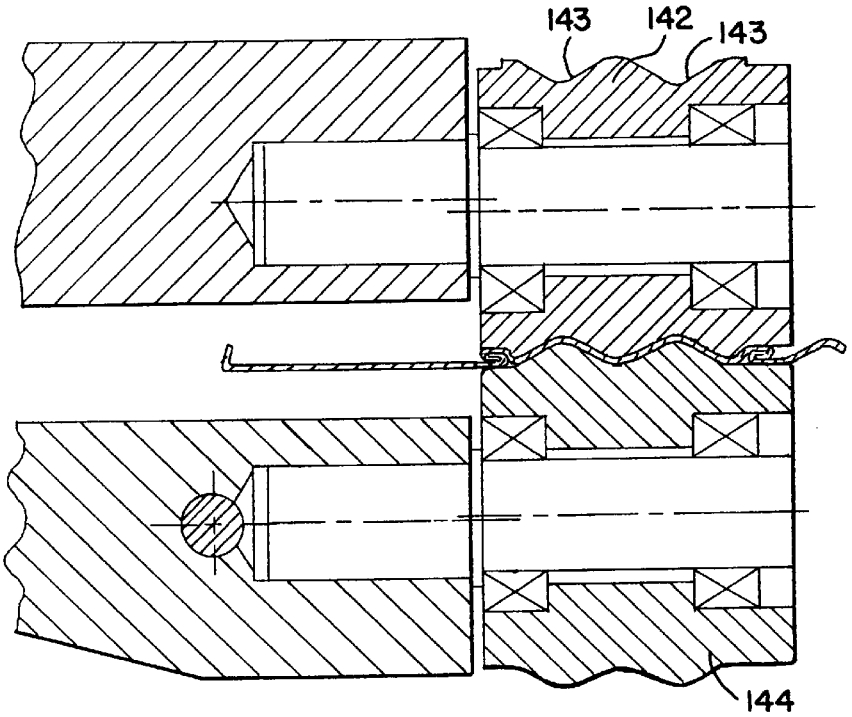
FIG. 10 is a partial cross-sectional view of a corrugation module illustrating an alternative embodiment of inner and outer corrugation rollers.

In a preferred embodiment, the corrugation module 12 is aligned on the forming head so that the rollers 42, 44 are parallel to the lockseam 104 on the pipe 96. The lockseam is composed of several folded layers of the pipe material and can pose difficulties to the corrugation unit if the rollers attempted to place a corrugation groove across a lockseam. Accordingly, the corrugation unit is aligned parallel to the lockseam so that all corrugation grooves are formed in a manner so that the metal strip is not pulled in or out of the forming head by the corrugation rollers. As shown in FIGS. 5 and 9, a top plate 106 cooperates with bolts 108 and the threaded holes 40 in the forming head mounting plate 38 to hold the corrugation module to the forming head. To allow for fine alignment of the rollers with the lockseam, the bolt holes 110 in the outer shaft holder 66 are oversized to permit for some adjustment in the angle of mounting between the corrugation module and forming head. Set screws 112 in the mounting plate 38 may be adjusted to maintain alignment reference while tightening the corrugation module 12 to the forming head and to allow removal and replacement of the corrugation module to its aligned position.

Figure 11:
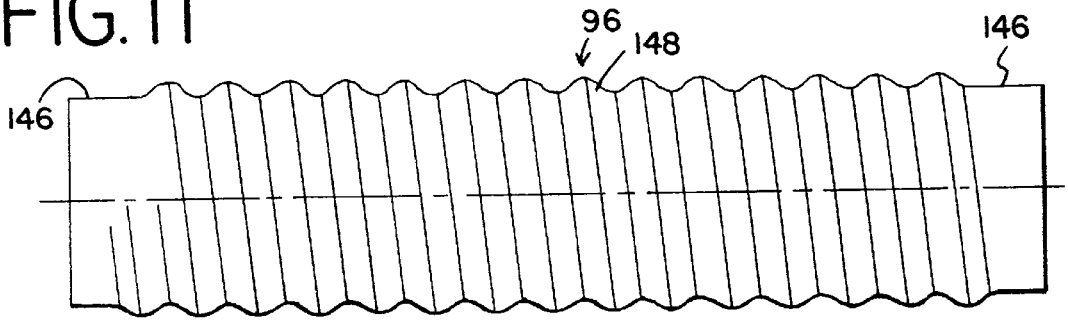
FIG. 11 is a side elevational view of a corrugated spiral pipe that may be formed on the pipe forming and cutting apparatus of FIG. 1 according to a preferred embodiment.

Although the corrugated spiral pipe forming and cutting apparatus 10 has been described with one particular set of rollers and one particular corrugation unit configuration, other configurations are contemplated. For example, the corrugation rollers may be formed having multiple corrugation grooves or corrugation grooves of differing geometries. FIG. 11 illustrates an outer corrugation roller 142 and an inner corrugation roller 144 designed to form two corrugation grooves between each lockseam on a spirally formed pipe. The outer corrugation roller 142 includes two circumferential recesses 143 and the inner corrugation roller 144 includes two complementary circumferential protrusions 145. The rollers may be configured to work with outside or inside lockseams. In other embodiments the outer shaft holder may be axially or pivotally movable while the inner shaft holder is fixed. In yet other embodiments, both inner and outer shaft holders may be movable with respect to one another. The force producing mechanism that drives the rollers together may be a hydraulic cylinder assembly as shown or any of a number of force producing devices such as pneumatic cylinders, linear motors, voice coils, an ACME screw and nut mechanism and so on. Linkage mechanisms other than the basic cantilever action of the inner shaft holder around a pivot pin may be implemented to allow for different orientation or positioning of the hydraulic cylinder or other force producing device. Additionally, the corrugation rollers may be passively rotatable or actively driven by a motor.

Figure 12:
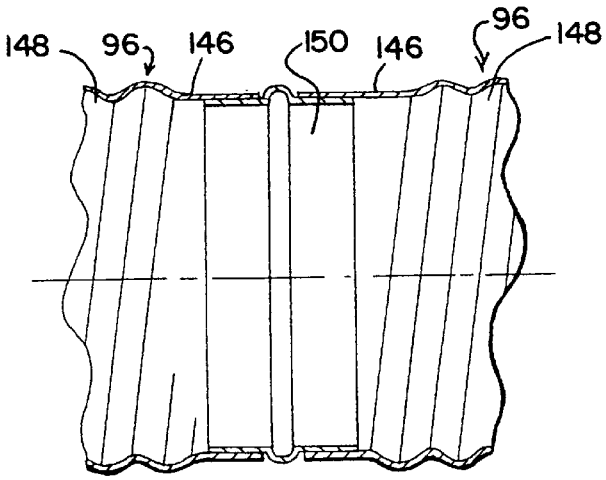
FIG. 12 is a partial sectional view of a joint formed between two pipes formed according to a presently preferred embodiment.
Figure 13:
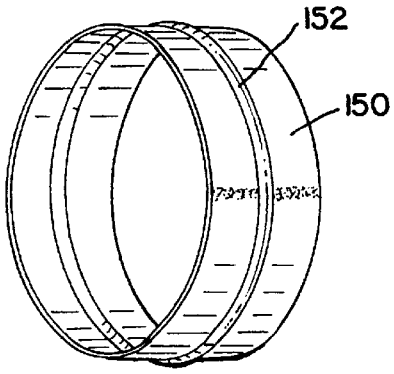
FIG. 13 illustrates an inside sleeve suitable for use in forming the joint illustrated in FIG. 12.

An example of a type of corrugated pipe 96 that may be produced using the apparatus 10 described above is illustrated in FIG. 11. In one embodiment, the pipe 96 includes smooth, spirally formed sections 146 at either end and a corrugated portion in the center section 148. Advantages of this type of pipe 96 are that knives, rather than saw blades, may be used to cut the pipe, and pipe sections may be produced with consistent diameters at each end. The consistent diameter ends also allow pipe sections to be easily and securely coupled with each other without the need to rework the ends of the pipe to match diameters, as is sometimes the case with continuously corrugated pipe sections. The pipe sections 96 may be connected together using an inside sleeve 150 having a protruding rim 152 integrally formed along the outer circumference as shown in FIGS. 12 and 13. The inside sleeve may be constructed of metal or other suitable material.

The operation of the corrugated spiral pipe forming and cutting apparatus 10 is described below. The operation is similar in many respects to that described in detail in U.S. Pat. Nos. 4,706,481 and 5,636,541. The entire disclosure of those patents is incorporated by reference herein.

Referring to FIG. 1, strip of metal (not shown) is prepared and pushed through the forming head. The pipe former passes the strip of metal between the mandrel 18 and the forming head, and into the inner circumference of the forming head, in a helical manner so that the adjacent edges of the coiled strip overlap. Folding and lockseam rollers cooperate to fold the adjacent edges of the coiled strip and compress the folded edges into a helical lockseam in a known manner. During the pipe forming process, the pipe moves axially as it rotates.

Preferably, the inner corrugation roller 44 is in a retracted, non-corrugating position (FIG. 4.) so that the pipe 96 does not contact the roller as a smooth spiral length is formed. The outer corrugation roller 42 is preferably in an axially fixed position with respect to the pipe and is also aligned so as not to interfere with the pipe as the spirally formed pipe emerges from the forming head. When corrugations are desired in the formed pipe, the cylinder assembly on the end of the outer shaft holder extends the piston and pivots the inner corrugation roller toward the outer corrugation roller until the metal pipe wall bends to conform to the shape of the complementary overlapping rollers. Corrugations are then formed as the pipe rotates and proceeds longitudinally from the forming head. In one embodiment, the rollers combine to create a single rounded corrugation between lock seams. In other embodiments, wide metal strips may be used and multiple corrugations may be formed in the spiral pipe between each lockseam. When the desired length of corrugation has been achieved, the cylinder assembly retracts the piston and the rollers separate to permit uncorrugated formed pipe to continue moving out of the forming head. In a preferred embodiment, the beginning and end of each corrugated length of pipe is formed with a smooth, uncorrugated portion and the inner and outer knives are used to smoothly and squarely cut lengths of pipe.

After a desired overall pipe length is reached, the cylinder assembly associated with the outer knife activates to move the outer knife into an overlapping position with the inner knife to cut the pipe. As the apparatus 10 continues to produce pipe, the pipe moves axially with, and rotates between, the overlapping inner and outer knives 28, 30. The pipe is preferably completely severed after one revolution. A guide shaft piston assembly connected to the guide runners 22 and the legs 24 assists with movement of the inner and outer knives, the mandrel, and slides with the pipe 96 as a cut is made. In a preferred embodiment, the various cylinder assemblies are hydraulic or pneumatic cylinder assemblies. Other actuating devices, such as stepper motors may also be used. Once the cutting process is complete, the liquid or air supplied to the cylinder assemblies associated with the outer knife and guide runners will be reversed. Accordingly, the outer knife moves away from the pipe, and the guide runner piston assembly pulls all the components fixedly connected to the guide runners 22 back to an initial position. The pipe former and cutter 10 may be configured to automatically form and cut corrugated pipe, as shown in FIG. 11, having a desired overall length.

An advantage of the presently preferred method and apparatus is that corrugations may be controllably and selectively created in spiral pipe. Additionally the accuracy of existing non-corrugated spiral pipe cutters may be used by creating corrugated pipe with smooth-walled, non-corrugated spiral pipe at the leading and trailing ends of each pipe segment. The non-corrugated ends not only permit accurate cuts, but also permit tighter seals between pipe segments and reduce the need to adjust the ends of corrugated pipe to mate properly.

From the foregoing, a corrugated spiral pipe forming and cutting apparatus having a controllable corrugation unit has been described. The apparatus helps improve pipe former flexibility by allowing any amount of corrugation to be formed, and improves the quality of the cut possible on corrugated pipe. Additionally, specialized pre-forming equipment to make continuously corrugated strips of material and equipment for reworking the ends of pipe sections is unnecessary.

It is intended that the foregoing detailed description be regarded as illustrative rather than limiting, and that it be understood that the following claims, including all equivalents, are intended to define the scope of this invention.

I claim:

1. A pipe forming apparatus for forming spirally formed corrugated pipe, wherein the pipe moves in an axial direction and rotates while it is being formed, the pipe forming apparatus comprising:

a forming head for receiving an uncorrugated strip of material and coiling the material into a spiral pipe, the forming head having an inner diameter, an entering end and an exit end; and a selectively operable corrugation module associated with the forming head, the corrugation module comprising:

a first rotatable corrugation roller positioned outside of the spiral pipe and adjacent to the exit end of the forming head;

a second rotatable corrugation roller positioned inside the spiral pipe and adjacent to the exit end of the forming head; and a force producing mechanism configured to move at least one of the first and second corrugation rollers between a non-corrugating position where the first and second corrugation rollers are maintained in a spaced apart relationship, and a corrugating position where the first and second rollers are maintained in an overlapping position, wherein spiral pipe emerging from the forming head is corrugated as it moves in the axial direction and rotates between the first and second corrugation rollers.

2. The pipe forming apparatus of claim 1, wherein the first rotatable corrugation roller is mounted in a rotatable, axially fixed position adjacent to the exit end of the forming head.

3. The pipe forming apparatus of claim 1, wherein the force producing mechanism is a hydraulic cylinder assembly.

4. The pipe forming apparatus of claim 1, wherein the second rotatable corrugation roller is pivotally mounted with respect to the first rotatable corrugation roller.

5. The pipe forming apparatus of claim 1, wherein the first rotatable corrugation roller comprises a recessed circumferential portion configured to receive a protruding circumferential portion on the second rotatable corrugation roller.

6. The pipe forming apparatus of claim 1, wherein the first corrugation roller comprises a plurality of circumferentially recessed regions positioned to cooperate with a plurality of circumferentially protruding regions on the second corrugation roller.

7. The pipe forming apparatus of claim 1, wherein the first corrugation roller comprises a plurality of circumferentially recessed regions positioned to cooperate with a plurality of circumferentially protruding regions on the second corrugation roller.

8. The pipe forming apparatus of claim 1, wherein the corrugation module further comprises a first arm connected to the first corrugation roller and a second arm connected to the second corrugation roller, and wherein the force producing mechanism is positioned to apply a force to the first arm and the second arm, whereby the force producing mechanism moves the first and second rollers between the corrugating position and the non-corrugating position.

9. The pipe forming apparatus of claim 1, wherein the corrugation module further comprises a first arm having an eccentric shaft adjustably mounted on a shaft holder at a first end and rotatably connected to the first corrugation roller at a second end.

10. The pipe forming apparatus of claim 2, wherein the second corrugation roller is axially movable relative to the first rotatable corrugation roller.

11. The pipe forming apparatus of claim 8, wherein the first arm is fixedly attached to the forming head and the second arm is pivotally movable with respect to the forming head.

12. The pipe forming apparatus of claim 9, wherein the corrugation module further comprises a second arm having an eccentric shaft adjustably mounted in a shaft holder at a first end and rotatably connected to the second corrugation roller at a second end.

13. The pipe forming apparatus of claim 12, wherein the force producing mechanism is mounted to an end of the shaft holder of the first arm opposite the eccentric shaft.

14. The pipe forming apparatus of claim 12, wherein each eccentric shaft has a first cylindrical portion and a second cylindrical portion, and wherein an axis of the first cylindrical portion is off set from an axis of the second cylindrical portion.

15. A method of producing corrugated spirally formed pipe, the method comprising:

receiving an uncorrugated strip of material at a forming head of a spiral pipe former;

forming a spiral pipe in the spiral pipe former;

selectively engaging a corrugation module having first and second corrugation rollers positioned adjacent the forming head to move the first and second corrugation rollers into a corrugating position from a non-corrugating position and producing a length of corrugated pipe; and disengaging the corrugation module by moving the first and second corrugation rollers into a non-corrugating position and producing a length of uncorrugated pipe.

16. A method of producing corrugated spirally formed pipe, the method comprising:

receiving a strip of material at a forming head of a spiral pipe former;

forming the strip of material into a spiral pipe in the spiral pipe former;

forming a first length of uncorrugated pipe on the spiral pipe former;

engaging a corrugation module and forming a length of corrugated pipe on the spiral pipe former while the pipe former is continuously forming spiral pipe; and disengaging the corrugation module and forming a second length of uncorrugated pipe.

17. The method of claim 16, further comprising cutting the pipe after forming the second section of uncorrugated pipe, wherein a corrugated pipe having first and second uncorrugated ends is produced.

18. The method of claim 16, wherein engaging the corrugation module comprises moving a first corrugation roller positioned on one side of a wall of the pipe against a second corrugation roller positioned on an opposite side of the wall of the pipe, wherein the wall of the pipe is corrugated as it rotates and axially moves between the first and second corrugation rollers.

* * * * *